US006203394B1

(12) United States Patent
Lee

(10) Patent No.: US 6,203,394 B1
(45) Date of Patent: Mar. 20, 2001

(54) ORNAMENTAL LIQUID COLOR BOX

(76) Inventor: Vincent Kuo Wei Lee, No. 42, Lane 458, Sheh Chung Street, Taipei (TW)

( * ) Notice: Subject to any disclaimer, the term of this patent is extended or adjusted under 35 U.S.C. 154(b) by 0 days.

(21) Appl. No.: 09/479,627

(22) Filed: Jan. 7, 2000

(51) Int. Cl.[7] ..... A63H 23/00
(52) U.S. Cl. ..... 446/159; 40/406; 446/153
(58) Field of Search ..... 446/153, 158, 446/166; 40/326, 406, 407, 412

(56) References Cited

U.S. PATENT DOCUMENTS 3,464,132 * 9/1969 Matisse ..... 40/326
4,693,025 * 9/1987 Landin ..... 40/326
5,272,604 * 12/1993 Lin ..... 40/406
5,704,313 * 1/1998 Gibbs ..... 40/406
5,706,594 * 1/1998 Lin ..... 40/406
5,711,099 * 1/1998 Nesbit et al. ..... 40/406

* cited by examiner

*Primary Examiner*—Sam Rimell
(74) *Attorney, Agent, or Firm*—Dougherty & Troxell

(57) ABSTRACT

An ornamental liquid color box includes stationary clear containers fixedly mounted on a cover of a seat. Propellers are provided on the seat to propel liquid colors flowing into the seat to liquid passages that are led to upper storing zones of the containers. Liquid colors sent to the upper storing zones then moves into narrowed middle display zones to form flattened and irregular drips before reaching lower storing zones of the containers and entering the seat again to complete a cycle of movement of the liquid colors in the liquid color box. The whole liquid color box need not be manually or mechanically turned to maintain continuous circulation of the liquid colors in the liquid color box. The propellers are driven to rotate by driving means that may be coil windings or a combination of a motor and magnet-loaded driving and driven gear wheels. No leakproof means, such as shaft seals, are required for the liquid color box.

7 Claims, 6 Drawing Sheets

ORNAMENTAL LIQUID COLOR BOX

BACKGROUND OF THE INVENTION

The present invention relates to an ornamental liquid color box, and more particularly to an ornamental liquid color box that has stationary liquid color containers and simplified driving mechanism to easily cause liquid colors to circulate in the containers and show changeful colors and views.

The liquid color box is a popular ornament and typically includes a transparent liquid color container divided into two or more spaces from front to rear side of the container. Generally, two spaces, namely, a front and a rear space, would be sufficient for the liquid color box to achieve an ornamental function thereof. Each space of the container further includes expanded upper and lower areas for storing one liquid color, and a narrowed middle area for displaying flattened and therefore differently shaped liquid color drips. Liquid colors stored in the upper storing areas flow downward to pass the middle displaying areas in a form of flattened drips that have irregular shapes. The irregularly shaped color drips in the two spaces of the container overlap one another to show changeful colors.

To enable circulation of the liquid colors in the container to provide continuous display effect, the containers of currently available liquid color boxes must be either manually or mechanically turnable. In the latter case, the liquid color containers are usually a round member and driven by motor and frictional gearing. Since the container of liquid color box usually has a certain volume and weight, it is necessary for the motor and frictional gearing to generate considerable driving force to rotate the container. Moreover, to enable the container to rotate stably without producing noise, complicate supporting seat or shaft is usually needed. As a result, conventional liquid color boxes tend to be clumsy and complicate and could not be massively produced to lower manufacture costs thereof.

It is therefore desirable to develop an improved liquid color box that eliminates drawbacks existing in the conventional liquid color boxes.

SUMMARY OF THE INVENTION

A primary object of the present invention is to provide an ornamental liquid-color box that includes stationary clear liquid containers fixedly mounted on a cover of a seat. The containers may be of any shape. Propellers are provided on the seat to propel liquid colors flowing into the seat to liquid passages that are led to upper storing zones of the containers. Liquid colors sent to the upper storing zones then moves into narrowed middle display zones before reaching lower storing zones of the containers and entering the seat again to complete a cycle of movement of the liquid colors in the liquid color box. The whole liquid color box need not be manually or mechanically turned to maintain continuous circulation of the liquid colors in the liquid color box.

Another object of the present invention is to provide the above-described ornamental liquid color box, wherein the propellers are driven to rotate by driving means that may be coil windings or a combination of a motor and magnet-loaded driving and driven gear wheels. No leakproof means, such as shaft seals, are required for these driving means in the liquid-color box.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
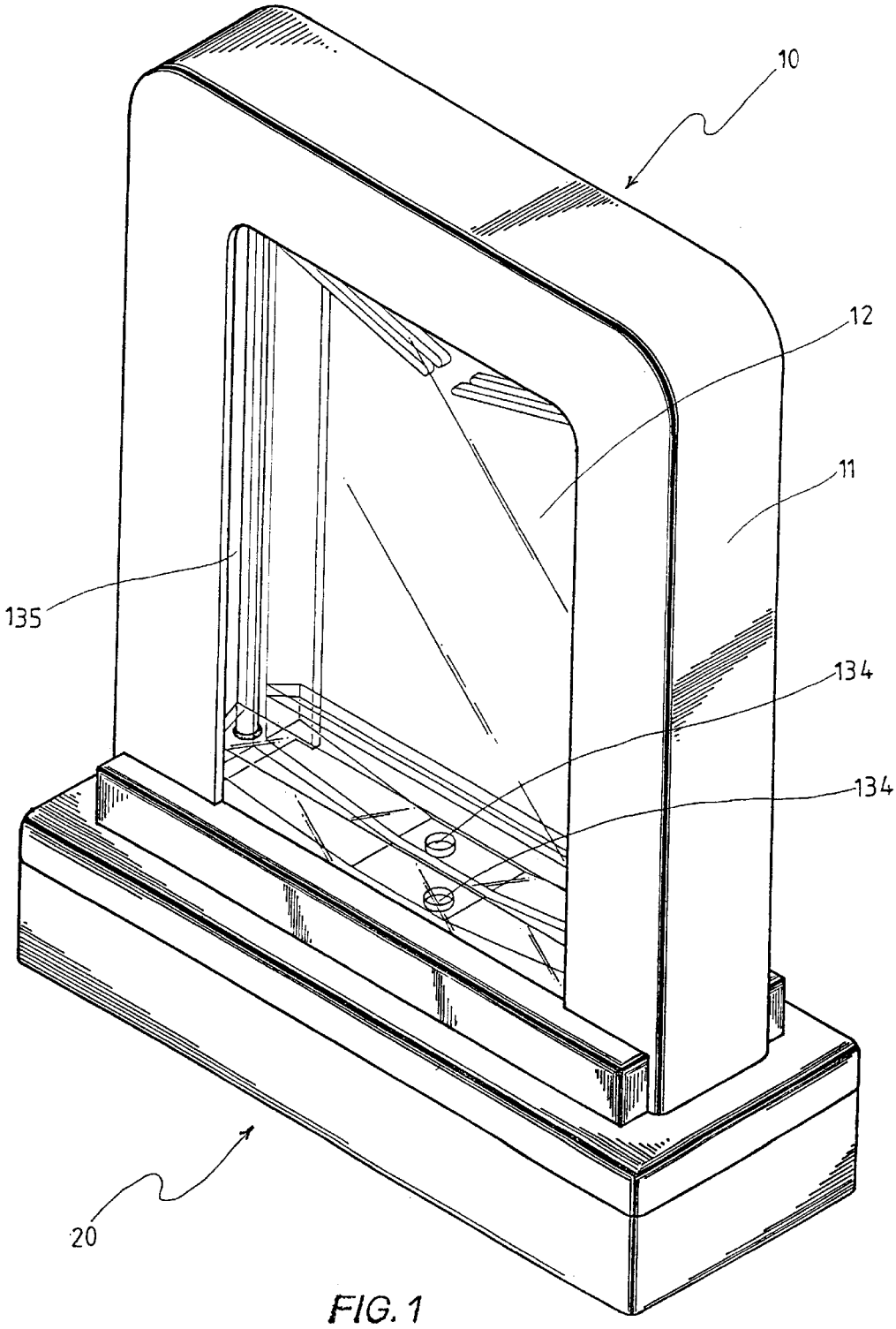
FIG. 1 is a perspective of an ornamental liquid color box according to a first embodiment of the present invention.
Figure 2:
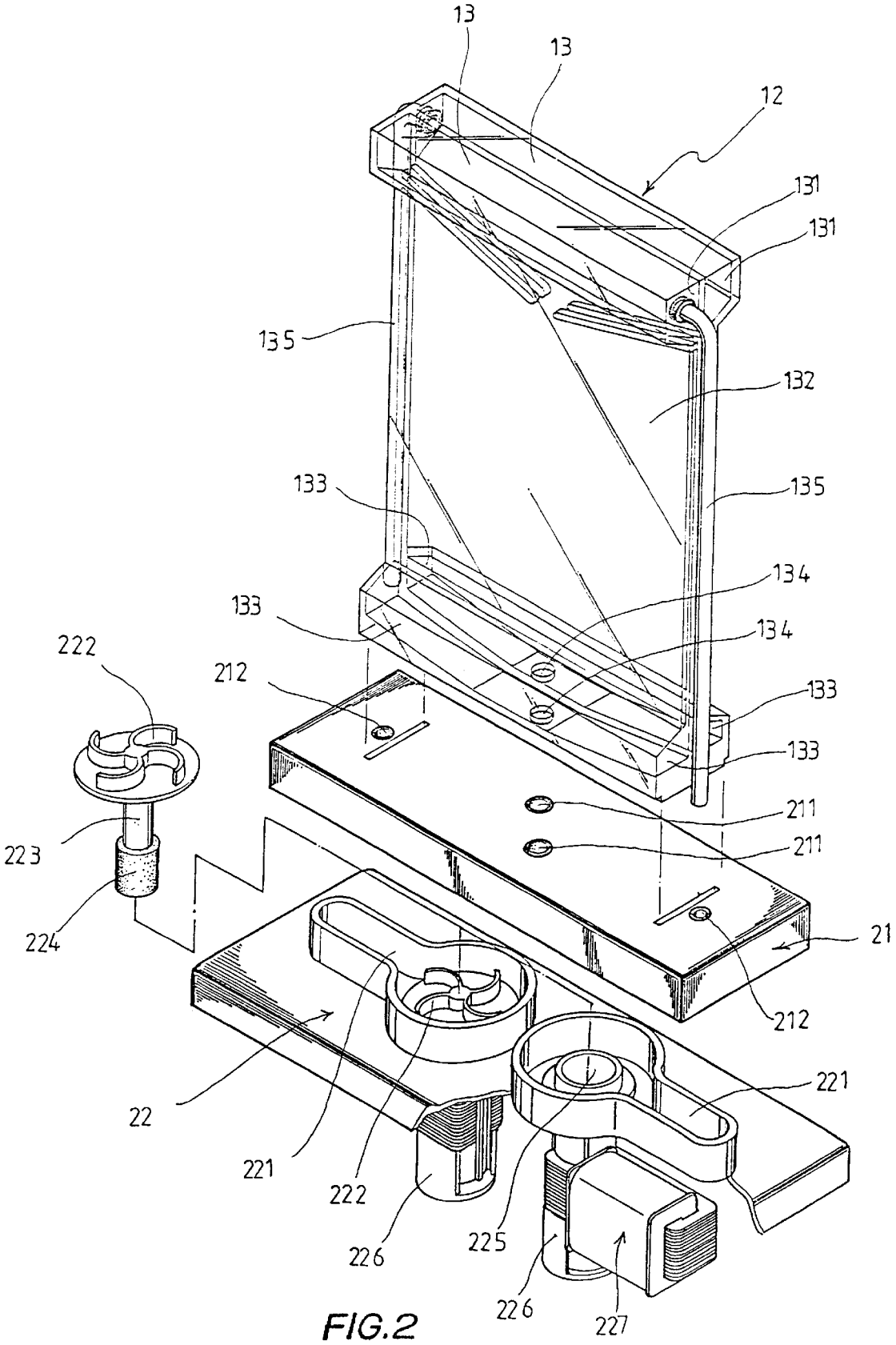
FIG. 2 is an exploded perspective showing internal structure and driving means of the liquid color box of FIG. 1, wherein an outer frame thereof is removed to better show the internal structure.
Figure 3:
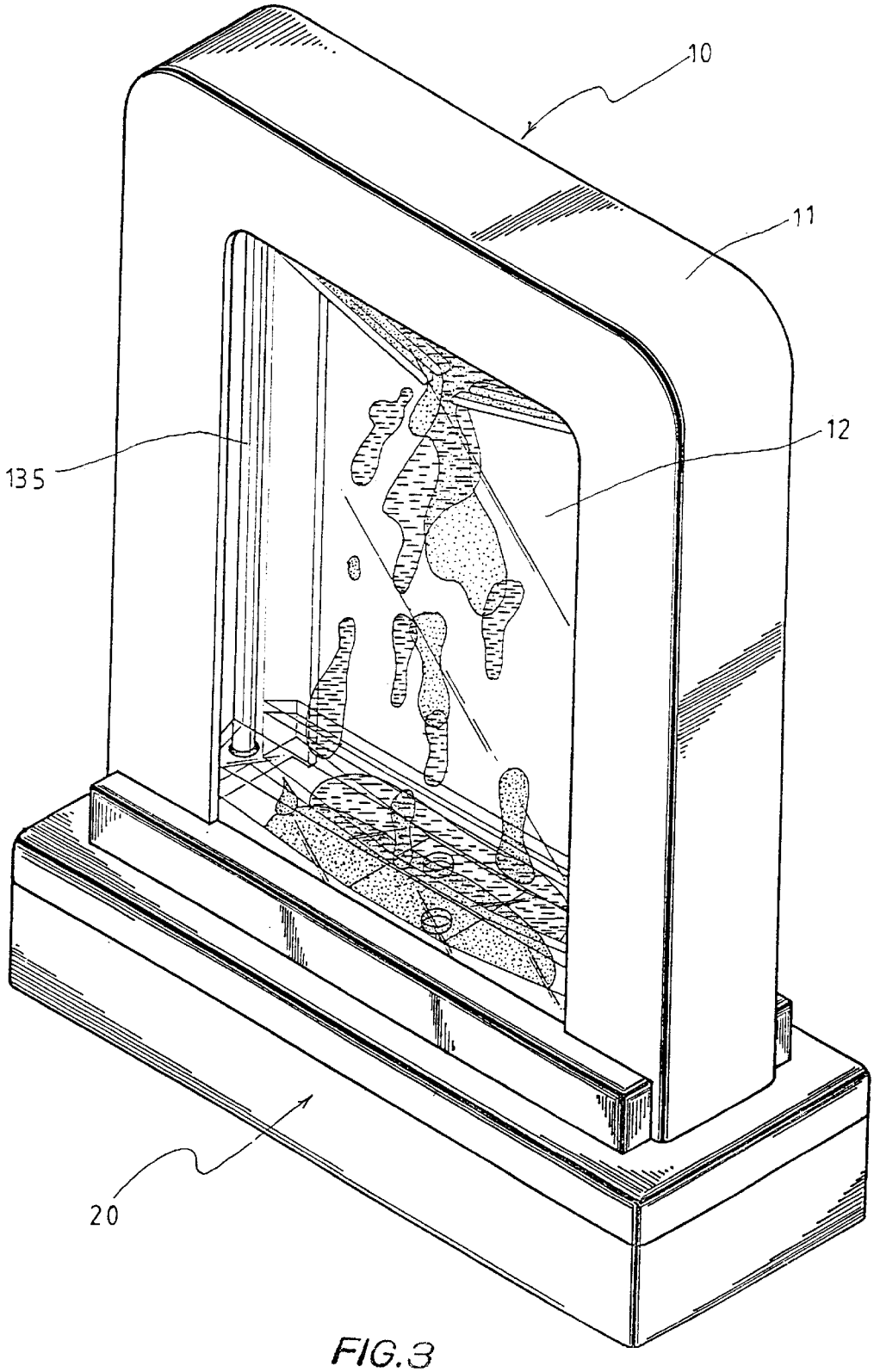
FIG. 3 is a perspective of the liquid color box of FIG. 1 with different liquid colors contained therein to produce moving, flattened and irregularly shaped color drips.

Please refer to FIGS. 1, 2 and 3 in which an ornamental liquid color box according to a first embodiment of the present invention is illustrated. The ornamental liquid color box in this first embodiment includes an upper part 10 for display purpose and a lower part 20 at where driving means for the liquid-color box is located.

The upper part 10 includes an outer frame 11 that may be of any suitable configuration and an inner display part 12 that is composed of two or more parallelly spaced and overlaid transparent containers 13. Generally, a display part 12 composed of only two containers 13 would be sufficient for the ornamental liquid color box of the present invention to work well. In this specification and the accompanying figures, ornamental liquid color boxes having a display part 12 composed of two containers 13 are described and illustrated as examples. Each container 13 of the display part 12 further includes an upper storing zone 131, a lower storing zone 133, and a narrowed middle display zone 132. Two different liquid colors are separately contained in the two containers 13. Each of the containers 13 is provided at a bottom thereof with a bottom hole 134, and outside one lateral side thereof with a tube 135. An upper end of the tube 135 is connected to the upper storing zone 131 and a lower end of the tube 135 is led to the lower part 20.

The lower part 20 mainly includes a cover 21 and a seat 22. The cover 21 is provided with two inlets 211 separately corresponding to the bottom holes 134 provided at the bottoms of the two containers 13, and two outlets 212 separately corresponding to two lower ends of the two tubes 135. The upper part 10 is firmly assembled to the cover 21 of the lower part 20 with O-rings (not shown) provided around joints of the bottom holes 134 and the inlets 211 as well as the lower ends of tubes 135 and the outlets 212 to keep these joints leakproof. The seat 22 is the place at where the driving means for the liquid color box is located. The seat 22 includes two generally keyhole-shaped liquid-supply zones 221 each of which corresponds to a set of inlet 211 and outlet 212 that correspond to the bottom hole 134 and the tube 135 for one container 13. When the cover 21 is closed onto the seat 22, the two liquid-supply zones 221 are sealed to form two closed spaces with only two openings each, that is, the inlet 211 and the outlet 212. Each of the keyhole-shaped liquid-supply zones 221 includes an expanded round portion in where a rotatable disk propeller 222 having multiple blades is disposed to upward face the inlet 211, and a narrowed elongate portion that extends outward from the round portion to locate an outer end thereof below the outlet 212.

The disk propeller 222 may be driven to rotate in different manners and a first one of which is shown in FIG. 1. In the first driving manner, there is provided a rotating shaft 223 having an upper end connected to a lower center of the disk propeller 222 and a lower end having a magnetic ring 224 put around it. And, in the round portion of each keyhole-shaped zone 221, there is formed a tubular recess 225 downward extending by a predetermined distance to form a lower wall 226. The rotating shaft 223 and the magnetic ring 224 around its lower end are received in the wall 226 of the tubular recess 225 with the disk propeller 222 located above the recess 225. A coil winding 227 is provided below the seat 22 with a core thereof surrounding the lower wall 226 of the tubular recess 225. With these arrangements, the disk propeller 222 is magnetically driven to rotate in the round portion of the liquid-supply zone 221.

Figure 4:
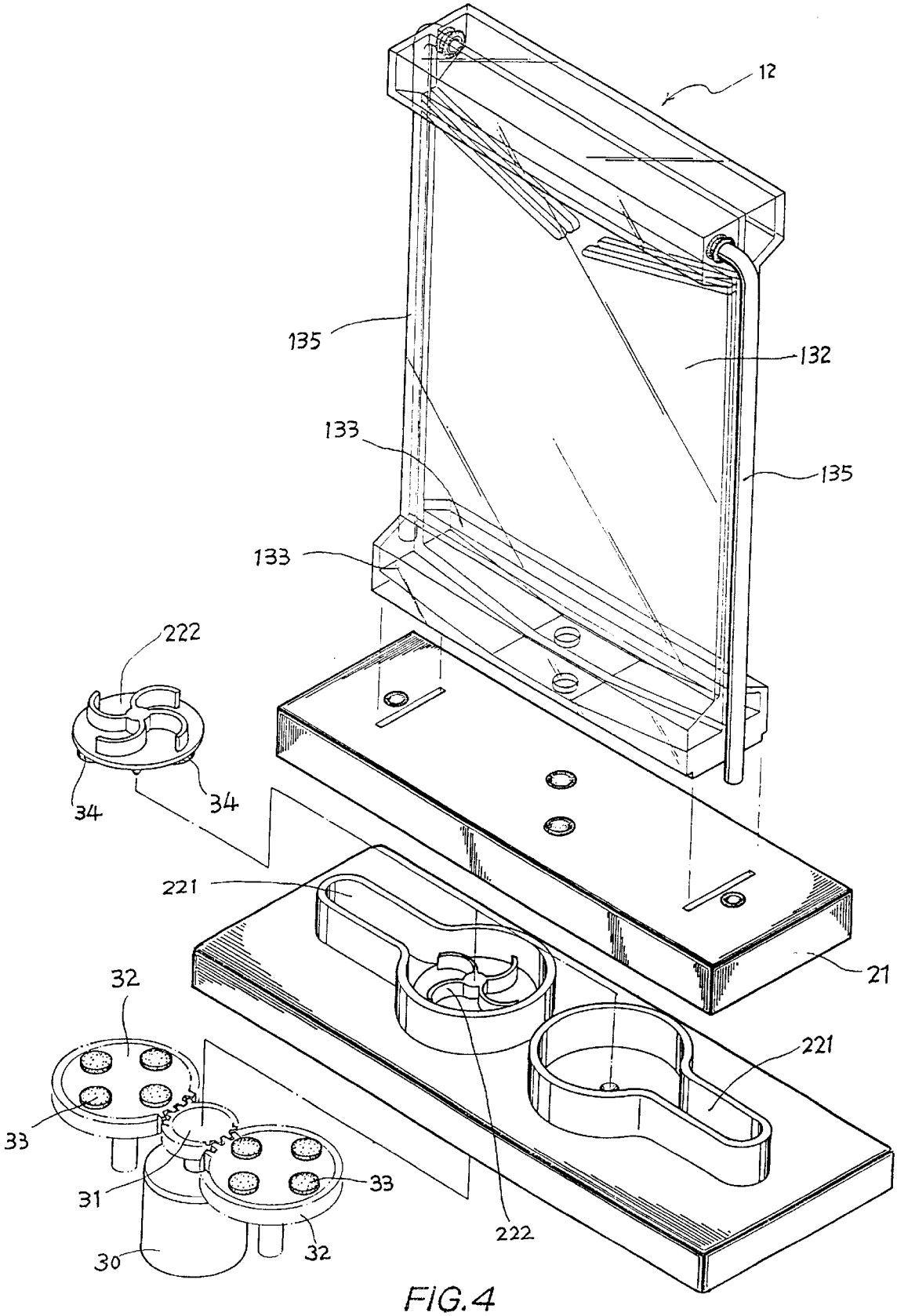
FIG. 4 is an exploded perspective of an ornamental liquid color box similar to that of FIG. 1 but employing different driving means.

FIG. 4 is an exploded perspective of an ornamental liquid-color box similar to that of FIG. 2 but using a different and simplified driving manner to drive the disk propellers 222 to rotate. In this second type of driving manner, the two disk propellers 222 have a plurality of first magnets 34 spaced on their bottom surfaces and are directly disposed in the round portions of the liquid-supply zones 221 formed on the seat 22. And, there are provided below the seat 22 a single motor 30, a driving gear wheel 31 connected to a top of a rotating shaft of the motor 30, and two driven gear wheels 32 separately meshing with the driving gear wheel 31 and therefore being brought to rotate along with the diving gear wheel 31. The two driven gear wheels 32 are separately located below the two disk propellers 222 and have a plurality of second magnets 33 provided on their top surfaces corresponding to the first magnets 34 of the disk propellers 222. When the motor 30 is started, the driving gear wheel 31 rotates and brings the driven gear wheels 32 to rotate simultaneously. At this point, the second magnets 33 on the driven gear wheels 32 magnetically attract the first magnets 34 on the disk propellers 222 to rotate the latter.

Figure 5:
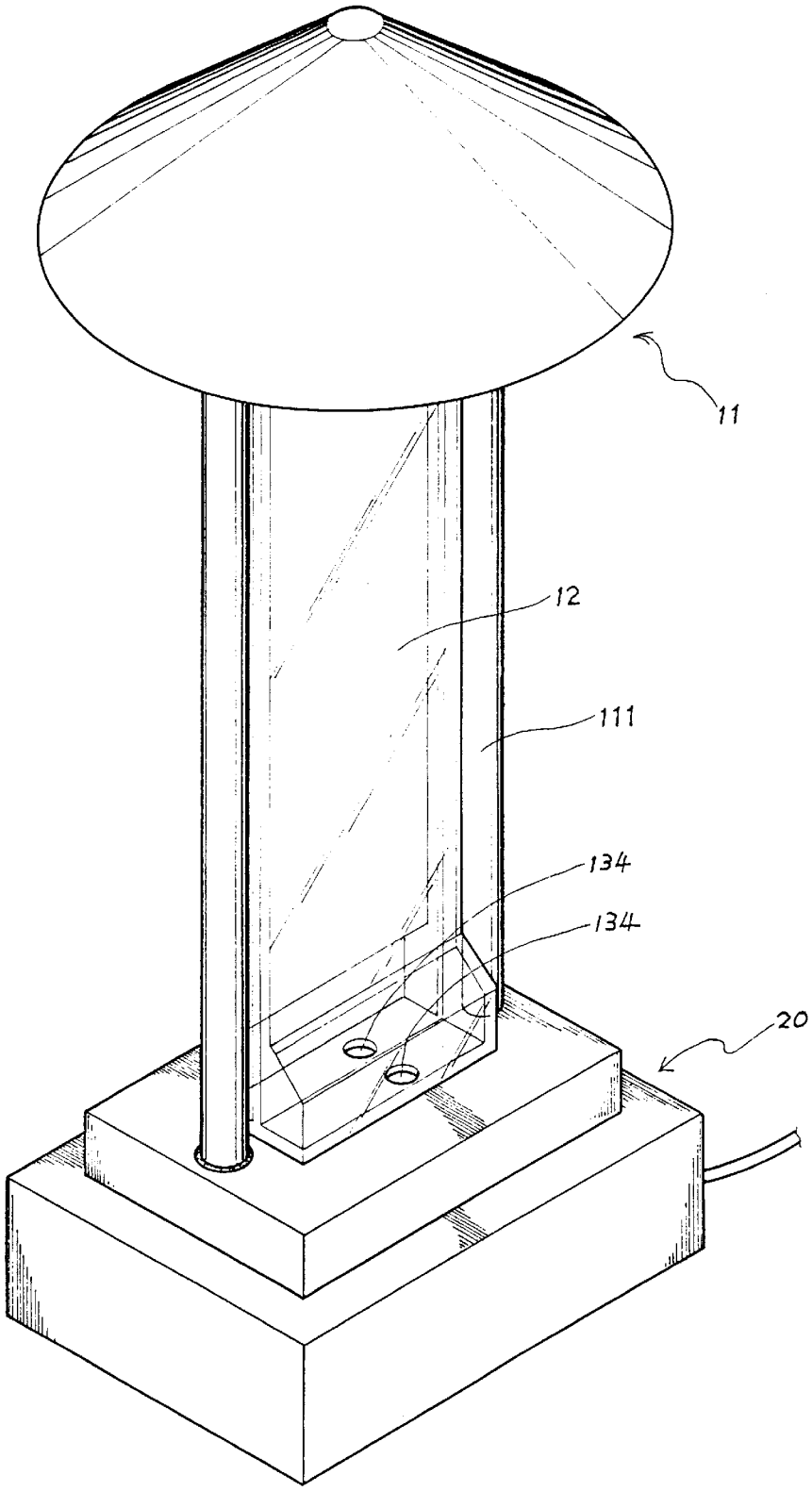
FIG. 5 is a perspective of an ornamental liquid color box according to a second embodiment of the present invention.
Figure 6:
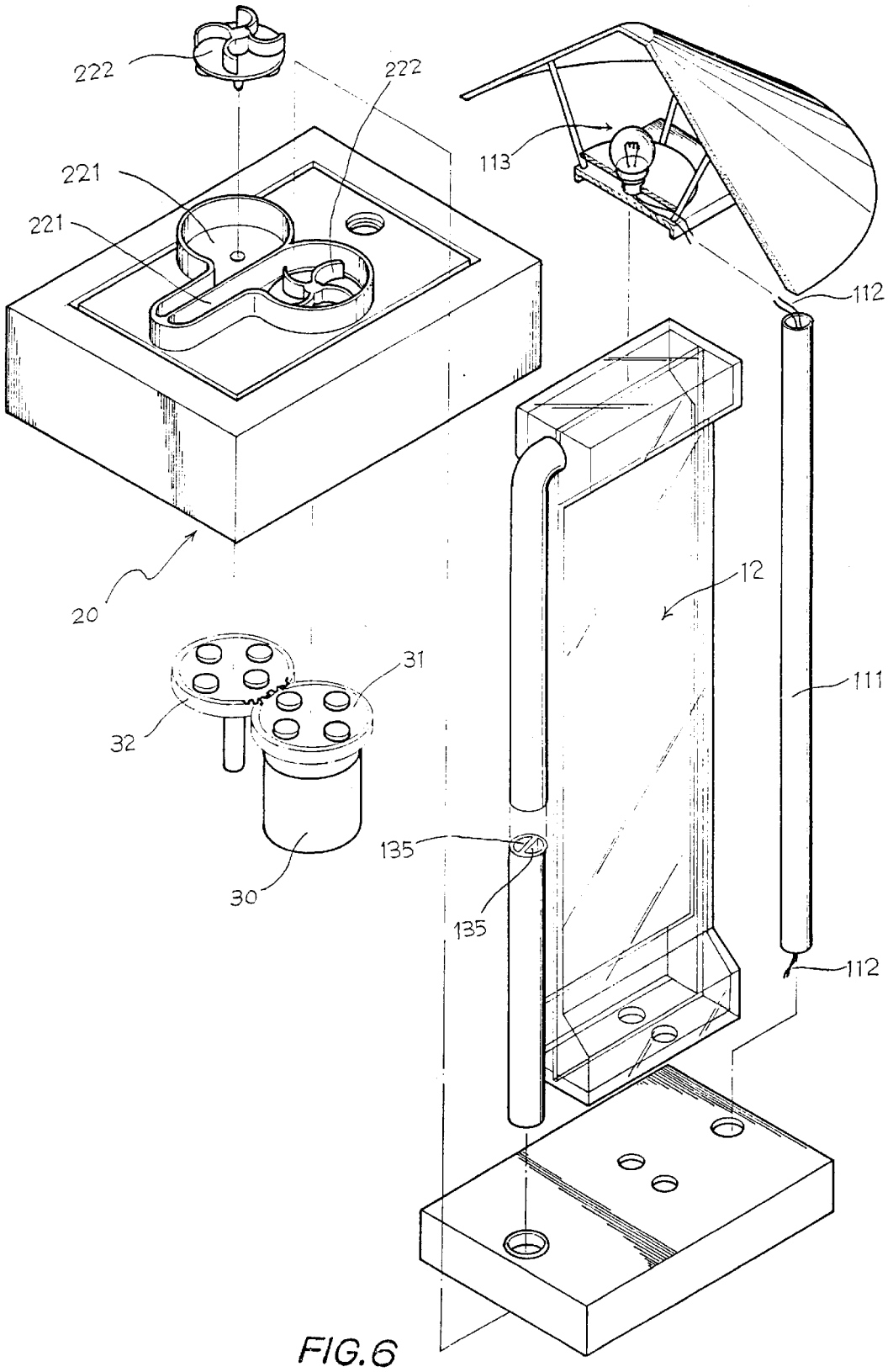
FIG. 6 is an exploded perspective of the liquid color box of FIG. 5 showing internal structure and driving means thereof.

FIGS. 5 and 6 illustrate a second embodiment of the ornamental liquid color box of the present invention. In this embodiment, the liquid color box includes a lampshade 11, a display part 12, and a lower part 20. The display part 12 is structurally similar to that of the first embodiment of FIG. 1 and includes, for example, two transparent containers 13 each having a bottom hole 134. A liquid tube providing two separated inner passages 135 is provided at one lateral side of the display part 12, such that upper ends of the two inner passages 135 are separately led to upper storing zones 131 of the two containers 13 and lower ends of the inner passages 135 are led to an outlet 212 formed on a cover 21 of the lower part 20. A wire tube 111 is symmetrically provided at another lateral side of the display part 12 corresponding to the liquid tube, so that a lower end of the wire tube 111 is connected to the lower part 20 and an upper end of the wire tube 111 is located below the lampshade 11. Wires 112 may be extended from the lower part 20 to a light emitting means 113 under the lampshade 11 via the wire tube 111, so that the ornamental liquid color box may also function like a lighting fixture.

To match with the liquid tube having two inner passages 135, a seat 22 of the lower part 20 in this embodiment is formed of two keyhole-shaped liquid-supply zones 221 abutted on each other side by side. Again, each of the liquid-supply zones 221 includes a round portion for a disk propeller 222 to dispose therein and an elongate portion having an outer end corresponding to the lower end of one inner passage 135. A driving gear wheel 31 connected to a top of a rotating shaft of a single motor 30 and a driven gear wheel 32 meshing with the driving gear wheel 31 are separately provided in the seat 22 below the disk propellers 222. First magnets 34 are provided at bottom surfaces of the disk propellers 222 and second magnets 33 at top surfaces of the gear wheels 31, 32. When the motor 30 is started, the driving gearwheel 31 and the driven gear wheel 32 rotate synchronously to magnetically drive the disk propellers 222 to rotate.

With the above-described arrangements, a circular path for liquid color is formed for each container 13, starting from the upper storing zone 131 and then sequentially passing the narrowed middle display zone 132, the lower storing zone 133, the bottom hole 134, the inlet 211, the liquid-supply zone 221, the disk propeller 222, the outlet 212, and the liquid tube or inner passage 135, and finally returning to the upper storing zone 131. When the disk propellers 222 are driven to rotate in the liquid-supply zones 221 in either manner as earlier mentioned, liquid colors in irregular drip form moving from the upper storing zones 131 to the lower storing zones 133 via the middle display zones 132 and into the liquid-supply zones 221 via the bottom holes 134 and the inlets 211 are propelled by the blades on the rotating disk propellers 222 to move into the elongate portions of the liquid-supply zones 221 and be sent into the liquid tubes or inner passages 135 via the outlets 212 to flow back into the upper storing zones 131 again. As a result, the liquid colors are kept flowing continuously round the liquid color box. Meanwhile, since the middle display zones 132 are largely narrowed in their depth (or thickness) compared to the upper and the lower storing zones 131, 133, liquid color drips flowing therethrough are flattened into irregular shapes. The irregularly shaped liquid colors in the two display zones 132 overlap one another to create changeful colors and accordingly very good ornamental effect.

The liquid color box of the present invention is characterized in that all components included in the liquid color box to form the circular path are stationary, except the disk propellers 222 and that no leakproof means are required for any types of the driving means. The liquid color box of the present invention can therefore be positioned in a stable manner without producing noise, compared to the conventional liquid color boxes that must be entirely rotated manually or by a motor.

It is noted that the display part 12 may be of any shape without any limitation so long as a circular path for the liquid colors can be maintained. For example, it is possible for the narrowed middle display zone 132 of the display part 12 to be a curved zone. And, by properly determining a total volume of the liquid color for each container 13, it is possible to omit the upper storing zone 131 and let the tube 135 be directly connected to the display zone 132.

What is claimed is:

1. An ornamental liquid color box comprising an upper part and a lower part, said upper part including an outer decorative part and a display part, said lower part including a cover tightly closing a seat below said cover;

said display part of said upper part being fixedly mounted on said cover of said lower part and composed of at least two overlaid but slightly spaced containers into which predetermined volumes of different liquid colors are contained, each of said containers including an upper storing zone, a lower storing zone, and a relatively thin middle display zone which is relatively thin as compared to said upper and said lower storing zones, such that liquid colors in said containers flow from said upper storing zones to said lower storing zones via said middle display zones to form flattened and irregular drips; each of said lower storing zones being provided with a bottom hole aligned with an inlet provided on said cover of said lower part, so that liquid colors in said containers may flow from said containers to said seat via said bottom holes and said inlets; and at least two independent liquid passages being separately provided outside said containers, such that upper ends of said at least two liquid passages are separately connected to said upper storing zones of said at least two containers and lower ends thereof to two outlets formed on said cover of said lower part; and said seat being formed of at least two keyhole-shaped liquid-supply zones, each of which including a round portion below one of said inlets on said cover and an elongate portion extended outward from the round portion to locate an outer end thereof below one of said outlets on said cover, and at least two disk propellers each having multiple blades being separately rotatably fixed in said round portions of said liquid-supply zones;

whereby when said disk propellers are driven to rotate by suitable driving means provided to said liquid color box, liquid colors flowing into said liquid-supply zones on said seat are propelled toward said elongate portions and sent upward into said liquid passages via said outlets on said cover to flow back into said upper storing zones of said containers and complete one cycle of movement of said liquid colors in said liquid color box.

2. An ornamental liquid color box as claimed in claim 1, wherein said at least two independent liquid passages are located between said outer decorative part and said containers so that they are not visible from outside of said liquid color box.

3. An ornamental liquid color box as claimed in claim 1, wherein said at least two independent liquid passages are two tubes provided at opposite sides of said display part.

4. An ornamental liquid color box as claimed in claim 1, wherein said at least two independent liquid passages parallelly extend in one tube.

5. An ornamental liquid color box as claimed in claim 1, wherein said liquid-supply zones each includes a tubular recess of suitable length for receiving a rotating shaft connected at an upper end to a bottom center of one said disk propeller that is located on said recess, and wherein said driving means provided to said liquid color box include coil windings having coils surrounding lower wall portions of said tubular recesses, so that said rotating shafts in said tubular recesses and accordingly said disk propellers connected to said rotating shafts are driven to rotate by said driving means.

6. An ornamental liquid color box as claimed in claim 1, wherein said disk propellers are provided at lower surfaces with first magnets, and wherein said driving means provided to said liquid-color box include a single motor, a driving gear wheel connected to a top of a rotating shaft of said motor, and two driven gear wheels meshing with said driving gear wheel to rotate along with the latter, said two driven gear wheels being provided at top surfaces with second magnets and separately located below said disk propellers, whereby when said motor is started and said two driven gear wheels are brought by said driving gear wheel to rotate, said second magnets on said driven gear wheels magnetically attract said first magnets on said disk propellers to cause said disk propellers to rotate.

7. An ornamental liquid color box as claimed in claim 4, wherein said at least two liquid-supply zones abut on one another side by side on said seat, wherein said disk propellers are provided at lower surfaces with first magnets, and wherein said driving means provided to said liquid color box include a motor, a driving gear wheel connected to a rotating shaft of said motor, and a driven gear wheel meshing with said driving gear wheel, said driving and said driven gear wheels having second magnets provided on their top surfaces and being separately located below said disk propellers disposed in said liquid-supply zones, whereby when said motor is started and said driving and said driven gear wheels are brought to rotate, said second magnets magnetically attract said first magnets on said disk propellers to cause said disk propellers to rotate.

* * * * *